United States Patent [19]

Pehker et al.

[11] Patent Number: 4,619,181

[45] Date of Patent: Oct. 28, 1986

[54] AMMUNITION AND MAGAZINE FOR AN AUTOMATIC LOADING ARRANGEMENT

[75] Inventors: Manfred Pehker, Duesseldorf; Erich Zielinski, Haan; Josef Metz, Neuss; Adolf P. Bierwirth, Kaarst, all of Fed. Rep. of Germany

[73] Assignee: Rheinmetall GmbH, Duesseldorf, Fed. Rep. of Germany

[21] Appl. No.: 711,394

[22] Filed: Mar. 13, 1985

[30] Foreign Application Priority Data

Mar. 13, 1984 [DE] Fed. Rep. of Germany ..... 3409018

[51] Int. Cl.[4] ..... F41D 10/14

[52] U.S. Cl. ..... 89/34; 89/45

[58] Field of Search ..... 89/34, 36.13, 45, 46, 89/47

[56] References Cited

U.S. PATENT DOCUMENTS 2,788,713 4/1957 Even ..... 89/45

3,501,996 3/1970 Lipp et al. ..... 89/34

*Primary Examiner*—Stephen C. Bentley

[57] ABSTRACT

An automatic loading arrangement of a gun barrel weapon. An ammunition holder is provided having a portion which is adapted to be pivotally connected to another ammunition holder and so on to form a band magazine, for the purpose of holding thin-walled cartridged ammunition units, preferably tank and armored vehicle ammunition having a combustible casing, which ammunition can be transported and guided to a loading tray or chamber without being damaged by outside influences, for example travel shocks, vibrations, etc.

The ammunition holder has a semi-circular arcuately shaped tray adapted to conform with the shape of the cartridged ammunition, which tray has a small inner diameter region to matingly receive the projectile head and a relatively larger inner diameter region adapted to matingly receive the cartridge bottom. Pivotally mounted holding clamps are mounted in the small and large inner diameter regions so as to encompass the ammunition at a longitudinal side thereof, which holding clamps includes corresponding opening and closing mechanisms which are adapted to be connected to each other via formlocking means. The formlocking means coact with the opening and closing mechanism and an ammunition expeller for purposes to provide, on the one hand, a uniform joint opening of the holding clamps and an ammunition sparing unloading process, as well as, on the other hand, a mutual independent reverse stroke of the holding clamps so that the thin-walled cartridged ammunition can be held in a soft-locking safety position in the ammunition holder in a radial play-free manner when exterior disturbing influences occur.

9 Claims, 15 Drawing Figures

AMMUNITION AND MAGAZINE FOR AN AUTOMATIC LOADING ARRANGEMENT

BACKGROUND OF THE INVENTION

The invention relates to an ammunition magazine for an automatic loading arrangement of the type disclosed and described in West-German published application No. 30 46 642. In the afore-mentioned West-German published patent application there is disclosed a band magazine for an automatic loading arrangement. This known band magazine has a flat silhouette so that it can be mounted in the turret of a tank or armored vehicle. Such known band magazine is of compact construction, so that it can accommodate as large a number as possible of cartridges, of possible different types of ammunition, in the immediate vicinity of the gun barrel, to thereby provide a time-saving feeding of cartridges thereto. This known band magazine transports the cartridges in transport trays transversely with respect to the longitudinal axis of the cartridge towards a turn-around position from which it is pushed out of the magazine by means of a turn-around lever and is slid into the loading chamber of the gun barrel. The individual links of the transport trays are pivotally joined to each other at the cartridged axes and these transport trays are guidingly fed along a peripheral path. The transport trays thereby form partial ammunition holders for receiving horizontally stored cartridges.

Experience with this type of known arrangement has, however, demonstrated that such X-shaped transport trays forming ammunition holders are not capable to transport thin-walled cartridged ammunition, in particular anti-tank ammunition having a combustible casing. This is due to the fact that impacts, shaking, vibrations, oscillations and similar disturbing influences, which occur during travel of the tank or armored vehicle, can cause damage or even destroy such sensitive type of ammunition. Such damage is above all caused by the fact that in such ammunition holders, as a result of manufacturing tolerances, a radial play between the cartridged and ammunition holder cannot be avoided, in particular also not because the cartridge in the region of its bottom relative to the region of the projectile head has different diameters. As a result of the play that occurs because of such manufacturing tolerances, damage to the sensitive ammunition is accelerated due to superimposed shaking movements, vibrations etc. which occur, on the one hand, between the rigid transportation tray and the projectile head region, and on the other hand, between the rigid walls of the transport trays and the cartridge bottom.

SUMMARY OF THE INVENTION

It is an object of this invention to provide an ammunition magazine for the above-described automatic loading arrangement, for holding thin-walled cartridged ammunition, preferable tank or armored vehicle ammunition having combustible casings, wherein exterior disturbing influences such as travel shocks, shaking movements, vibrations etc. are absorbed without damage to the ammunition which is transported on loading trays.

The arrangement of the invention advantageously distinguishes itself in that the ammunition magazine of this invention is in a position to receive cartridged ammunition having a stepped configuration, i.e. a number of different diameters. The ammunition magazine of this invention is capable to stably receive cartridged ammunition over its entire longitudinal extent and independently from the ever present manufacturing tolerances of the ammunition, respectively at the ammunition magazine, by means of a plurality of holding clamps which are pivotally arranged in the ammunition magazine and hold the individual ammunition units in motionless storage positions. A particular advantage of the invention resides in providing a holding clamp in the region of the cartridge bottom and another holding clamp in the region of the projectile head of the cartridged ammunition which holding clamps are mounted in the ammunition magazine. By means of such an arrangement the cartridged ammunition is securely and radially playfree held in the storage position according to its mass distribution, whereby the holding clamps by means of an opening and closing mechanism can separately individually follow the prevailing diameter of the cartridged ammunition in the holding region at the projectile head and at the cartridge bottom. The opening and closing mechanism includes a pretensioning means. Thereby, thin-walled cartridged ammunition, in particular tank or armored vehicle ammunition having a combustible casing, can be held radially playfree in the ammunition magazine even when extreme disturbing influences occur. By means of an external opening mechanism and by arranging the holding clamps on the same longitudinal side of the ammunition magazine and by way of the coupling possibility of the opening and closing mechanism for both holding clamps during the opening stroke, both holding clamps are simultaneously and uniformly moved from an encompassing holding position for the cartridged ammunition into an open releasing position for the cartridged ammunition. An external opening mechanism pivots the holding clamps. An advantageous embodiment of the invention includes a stroke-lever for each opening and closing mechanism, which lever is pivotally connected at one of its ends with the holding clamp and at the other of its ends has a bore for receiving an eccentric member which is arranged at a drive shaft of the opening and closing mechanisms. As a result of the fact that a safety position exists between the eccentric member and the stroke-lever, which causes a self-locking by means of a rotational moment-producing prestressing means which is under prestress in the closing direction, each holding clamp is safely held in the closed position.

According to a further feature of the invention the confronting ends of the drive shafts include form-locking means coupled thereto, whereby the formlocking means arranged on one drive shaft is formed as an automatically driven opening lever and the formlocking means arranged on the other drive shaft is formed as an entraining member having an offset portion and the opening lever as well as the offset portion of the entraining member are arranged and constructed in such a way with respect to each other that the entraining member is only joined in the entraining position with the opening lever during the opening process of the holding clamps, whereby the holding clamps can assume their closed position independently from each other, but do, however, permit a joint opening.

As a result of the fact that for a basic adjustment of the opening lever and the entraining member the stroke-lever must be joined to the holding clamp via a fine adjusting arrangement, it is possible to achieve a simple fine mutual adjustment in the holding position of the cartridge ammunition. The fine adjustment arrangement consists advantageously of a bolt formed as an eccentric member which is guided into the holding clamp and disposed in the guided region of the stroke-lever.

The cartridged ammunition is preferably uniformly and sparingly expelled from the ammunition magazine towards the ammunition magazine axis during the opening process of the holding clamps by the arrangement of an ammunition expelling mechanism disposed in the operative region of the holding clamps on the drive shaft.

As a result of the shape of the casing the ammunition magazine is constructed in the region of the cartridge body in such a way that with a horizontally moving band magazine the holding clamps are at all times arranged on the upper side or the lower side of the ammunition magazine at its exterior. The horizontally stored cartridged ammunition can advantageously be obliquely picked up from above at the rear turning point of the magazine or with open clamps at the forward turning point also be obliquely expelled downwardly.

By means of this advantageous arrangement and space-saving operational characteristic of the holding clamps, but last but not least as a result of the mechanical prestressing means consisting of coil band springs mounted about the drive shafts, there are formed small compact ammunition holders in so far as their exterior configurations are concerned, which form, as interlinked transport members, an endless band magazine which has a particularly small spatial requirement.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
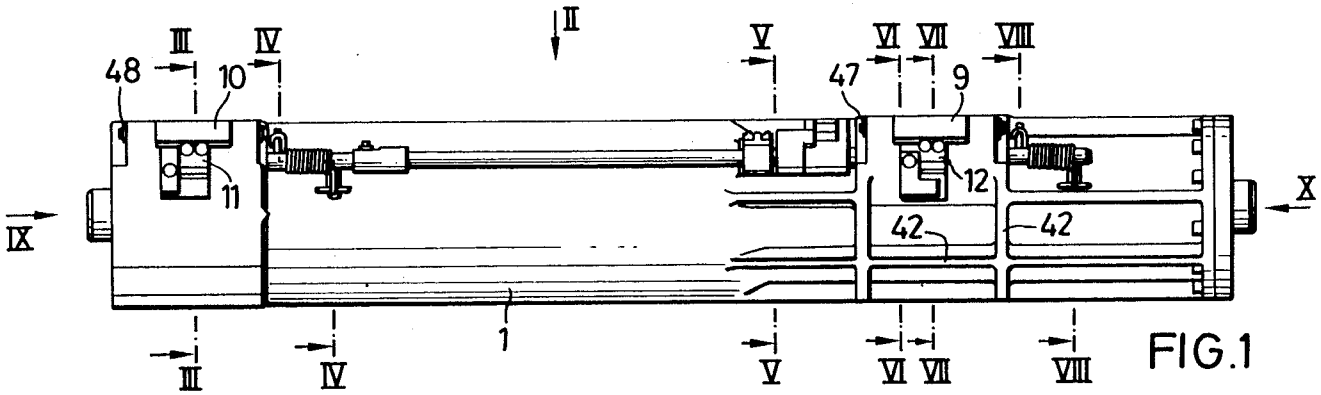
FIG. 1 is a longitudinal side elevational view of the ammunition magazine illustrating the opening and closing mechanisms for two holding clamps.
Figure 2:
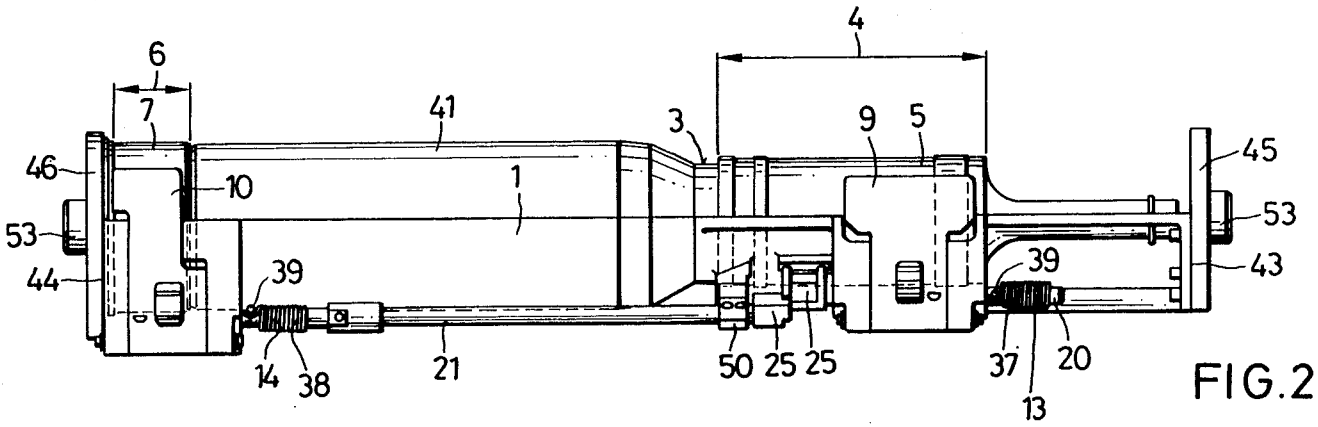
FIG. 2 is a plan view of the ammunition magazine in a direction of the arrow II in FIG. 1 in which there is disposed a cartridged ammunition unit held by the holding clamps.
Figure 3:
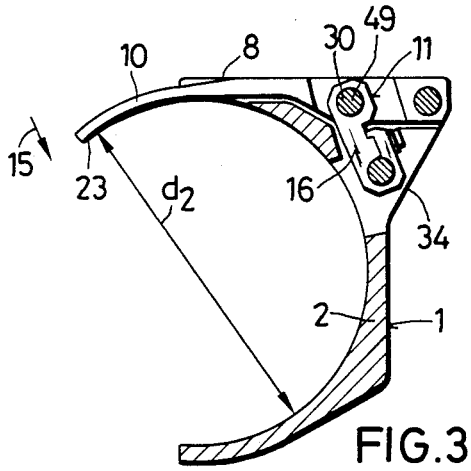
FIG. 3 is a cross-sectional view along the plane III—III in FIG. 1 illustrating the cross-sectional surface of the envelope curve of the ammunition holder in the region of the cartridge bottom showing the mounting arrangement of the holding clamp.
Figure 4:
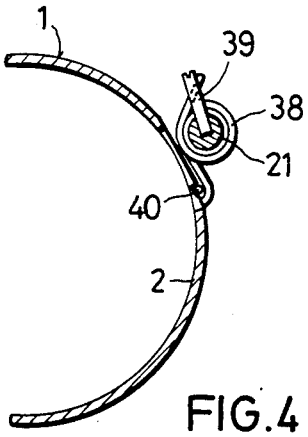
FIG. 4 is a cross-sectional view along plane IV—IV in FIG. 1 illustrating the cross-sectional surface where the wound bent spring is mounted on the drive shaft in a region of the ammunition holder corresponding to the cartridge bottom of the cartridged ammunition unit.
Figure 10:
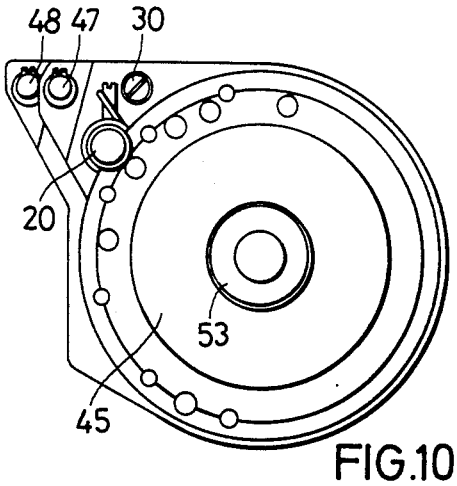
FIG. 10 is a side-elevational view along the arrow X in FIG. 1 of the ammunition holder illustrating the end of the ammunition holder as viewed from the right side.

There is illustrated in FIGS. 1 and 2 one entire ammunition holder 1 which forms part of a band magazine 35 and a not further illustrated automatic loading arrangement for a gun barrel weapon. The ammunition holder 1 includes, as is illustrated in cross-sectional views in FIGS. 3 to 8, a semi-circular arcuately shaped tray 2, the inner diameter of which is repeatedly offset for uniformly receiving thin-walled cartridged ammunition unit 3 adapted to be preferably used as a combat tank ammunition wherein each unit has a combustible casing. The offsetting of the cartridged ammunition unit 3 occurs in a region 4 of the projectile head 5 and in a region 6 of the cartridge bottom 7. In accordance with the differing diameters of the projectile head 5 and the cartridge bottom 7, the inner diameter $d_1$ of the transport tray 2 is smaller in the region 4 than the inner diameter $d_2$ in the region 6. The ammunition holder 1 is provided with reinforcing ribs 42 for providing a high holding stability in the receiving region 4 of the relatively heavy projectile head 5 in its outer region. In order to achieve a stable support for the ammunition unit 3 in the region of the cartridge bottom 7 and the region of the projectile head 5, the ammunition holder 1 is constructed in a non-illustrated manner in the regions of a combustible propellant charge casing 41 by rear-turned or machining. The ammunition holder 1 has at both ends faces 43, 44, which serve as axial limits for the ammunition unit 3, which form part of end walls 45, 46, whereby the end wall 45 is formed as a loose flange which is joined by a screwed connection, as is illustrated by the number of threaded bore holders in FIG. 10, and the end wall 46 is integrally joined with the ammunition holder 1.

The ammunition holder 1 is furnished in the regions 4, 6 on the same longitudinal side 8 with two pivotally mounted holding clamps 9, 10 which partially encompass the cartridged ammunition unit 3 on its periphery. The holding clamp 9 is for this purpose pivotally arranged on an axis 47 which is rigidly secured to the holder 1 by means of the opening and closing mechanism 12 (see FIGS. 5–7), whereas the holding clamp 10 is pivotally arranged on an axis 48 which is secured to the holder 1 by means of the opening and closing mechanism 11 (see FIG. 3).

Both of the opening and closing mechanisms 11, 12 consist essentially of a stroke-lever 16 which is pivotally connected to the holding clamps 9, 10 at the end 17 (see FIG. 13) and at the other end 18 has a bore 19 for receiving an eccentric member 22 which is arranged on a drive shaft 20, 21. The drive shafts 20, 21 are mutually offset and are mounted in the region of the holding clamps 9, 10 on the ammunition holder 1, whereby the shaft 21 is being additionally supported in a bearing 50 in the region 4 (see FIG. 2).

In order to carry out a radial and play-free holding function individually in the regions 4, 6 which are independent from each other, the drive shafts 20, 21 have in the closing direction 15 rotational moment-producing mechanical prestressing means 13, 14, which consists of wound coil springs 37, 38, respectively mounted about the drive shafts 20, 21. The ends of each coil spring 37, 38 are, on the one hand, secured at a pin 39 of the drive shafts 20, 21 and, on the other hand, at the pin 40 of the ammunition holder 1 (see FIGS. 4 and 8).

Figure 5:
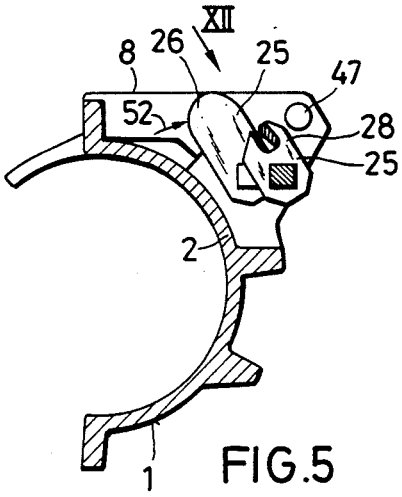
FIG. 5 is a cross-sectional view along plane V—V in FIG. 1 illustrating the cross-sectional surface of a semi-tray form of reduced diameter in a holding region of the ammunition holder arranged at the projectile head of the cartridged ammunition unit together with an arrangement of an opening lever connected to different drive shafts and an entraining member for the holding clamps.
Figure 12:
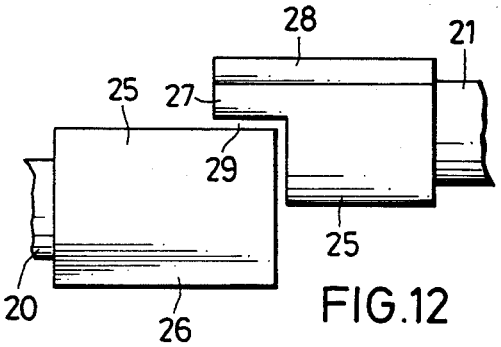
FIG. 12 is a plan view in the direction of the arrow XII in FIG. 5 illustrating the opening lever and the entraining member in an entraining position that occurs for both holding clamps during the opening process.

The ends of the drive shafts 20, 21 which confront each other, as in illustrated in FIGS. 5 and 12, include form-locking means 25 which can be coupled thereto, whereby the form-locking means 25 arranged on the drive shaft 20 is constructed as an automatically drivable opening lever 26 and the form-locking means 25 mounted on the drive shaft 21 is constructed as an entrainer 28 of an attachment 27. The attachment 27 of the entrainer 28 and the opening lever 26 are mutually arranged in such a way that only during the opening movement of the holding clamps 9, 10 the entrainer 28 is joined with the opening lever 26 in an entraining position 29 (see FIG. 12). In this manner both holding clamps 9, 10 are pivotally movable via a not illustrated opening drive by means of the opening lever 26 and the corresponding opening and closing mechanisms 11, 12 to move the clamps 9, 10 uniformly in the opening direction 51 (FIG. 13) from a holding position 23 in which they encompass the cartridged ammunition unit 3.

Figure 14:
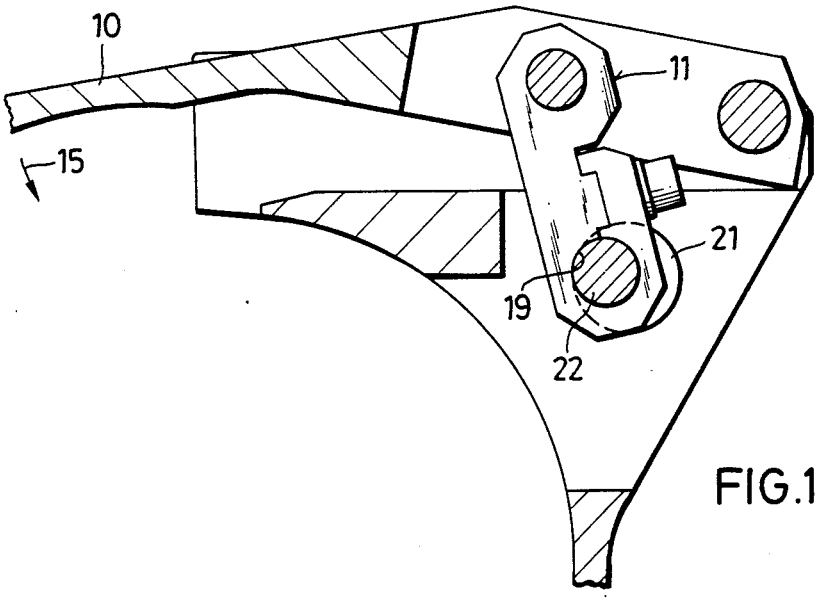
FIG. 14 is a cross-sectional view corresponding to that of FIG. 13 of the holding clamp when it is in a loading or unloading position via the opening and closing mechanism.

After disengagement of the opening lever 26 out of the external opening drive the attachment 27 affords that the entrainer 28 carries out a separate reverse of the holding clamps 9, 10 in the closing direction 15 (FIG. 14), so that the holding clamps 9, 10 adapt themselves to the corresponding prevailing ammunition diameters in the regions 4, 6.

Figure 13:
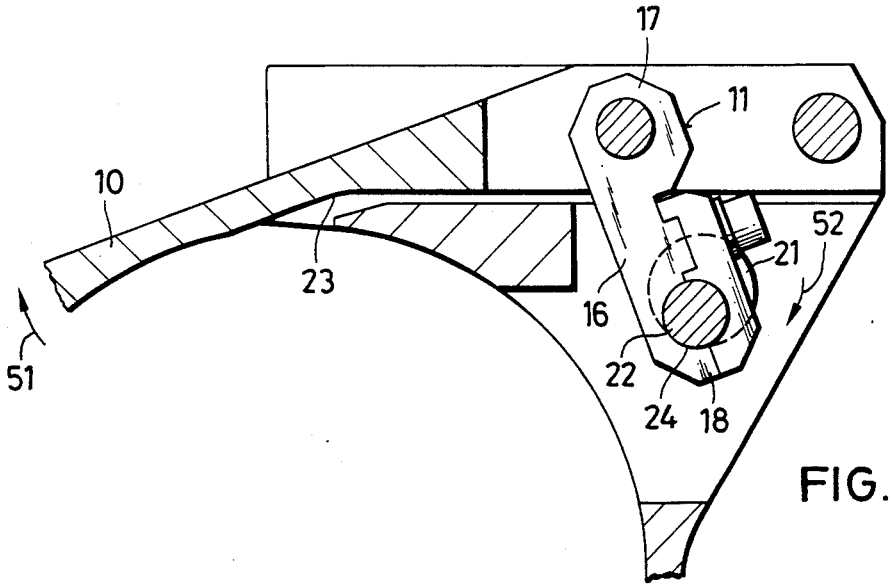
FIG. 13 is a partial cross-sectional view, at an enlarged scale, of the holding clamp illustrated in FIG. 3 when it is in a holding locked position via the opening and closing mechanism.

As is clearly illustrated in FIG. 13, a self-locking safety position 24 is present in the closed position 23 of the holding clamps 9, 10 between the eccentric member 22 and the stroke-lever 16 by way of prestress means 13, 14 (coil springs 37, 38) which are under prestress and act in the closing direction 15. This closing position 24 is released when the holding clamps are opened by virtue of the rotation of the drive shafts 20, 21 by means of the opening lever 26 (FIG. 5) in the direction 52.

Figure 11:
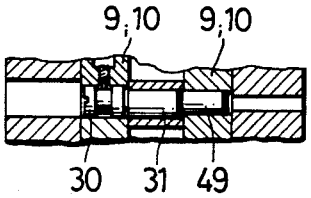
FIG. 11 is a cross-sectional view along the plane XI—XI of FIG. 9 which illustrates in cross-section a fine adjustment arrangement.

In order to make the basic adjustment of the opening lever 26 and the entrainer 28, the stroke-lever 16, according to FIG. 11, is joined via a fine adjustment arrangement 30 with the holding clamps 9, 10. The fine adjustment arrangement 30 consists essentially of a bolt 49 formed as an eccentric member 31 which is guided in the holding clamps 9, 10 and which is formed as an eccentric member in the guide region of the stroke lever 16. The fine adjustment can be externally carried out for each holding clamp 9, 10 at the end face thereof, even when they are in a built-in condition of the ammunition holder 1.

Figure 6:
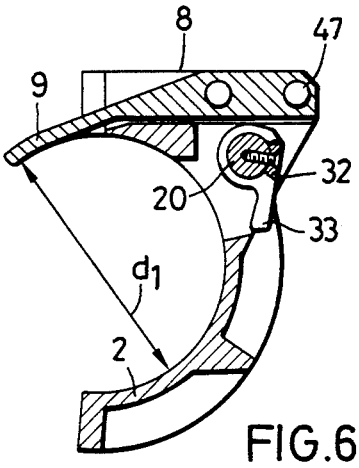
FIG. 6 is a cross-sectional view along plane VI—VI of FIG. 1 illustrating a cross-sectional surface of a holding clamp in the closed position and a retracted ammunition expeller which is fixedly mounted on the drive shaft.
Figure 7:
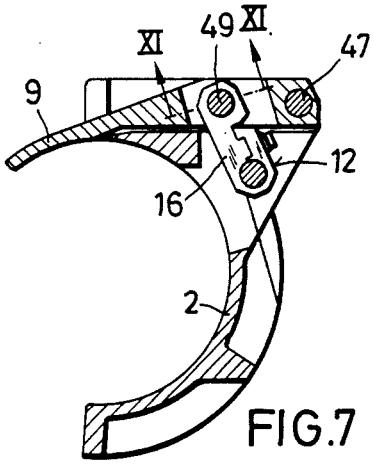
FIG. 7 is a cross-sectional view along plane VII—VII of FIG. 1 illustrating a cross-sectional surface which illustrates the arrangement of a holding clamp mounted in the region of the projectile head of the cartridged ammunition unit.
Figure 8:
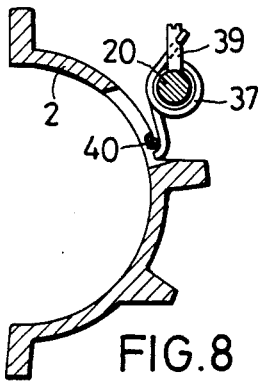
FIG. 8 is a cross-sectional view along the plane IIX—IIX of FIG. 1 illustrating the cross-sectional surface wherein the mounting of the wound bent spring about the drive shaft in a region of the ammunition holder corresponding to the projectile head of the cartridged ammunition unit.
Figure 9:
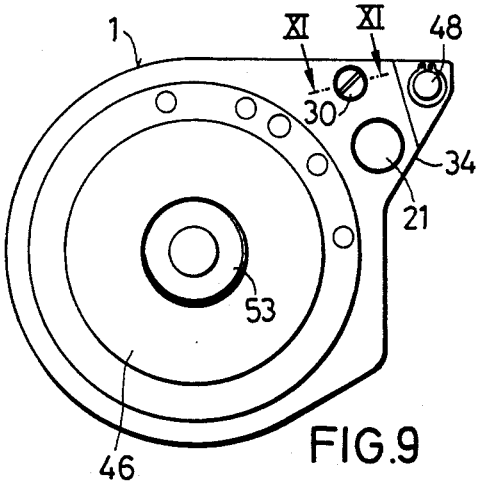
FIG. 9 is a side-elevational view along the arrow IX of FIG. 1 illustrating the end of the ammunition holder as viewed from the left in FIG. 1.

In order that the cartridged ammunition is sparingly and uniformly expelled from the holder, each drive shaft 20, 21 includes in the operative region of the holding clamps 9, 10 an ammunition expeller 32 which has a lever 33 as is illustrated in FIG. 6.

Figure 15:
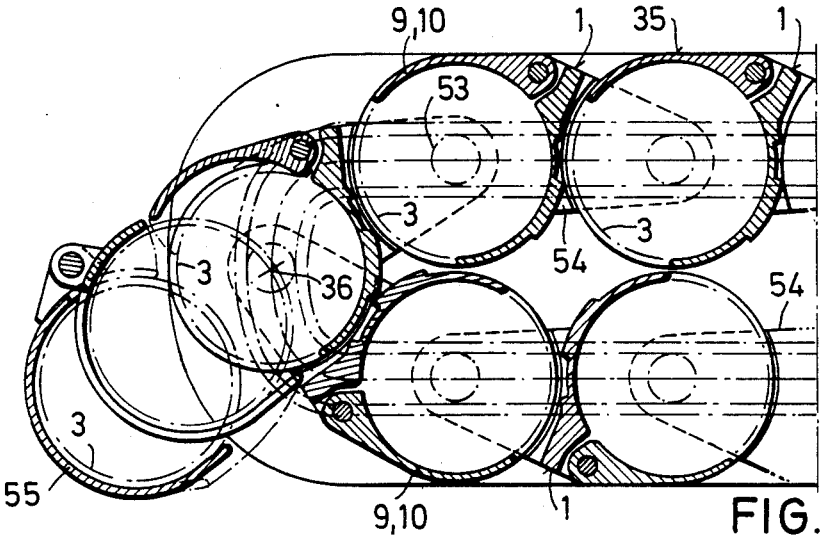
FIG. 15 is a cross-sectional side-elevational view of the parts forming a band magazine which parts are interlinked with each other to form the ammunition magazine of this invention.

As is illustrated in FIG. 15, the ammunition holders 1, when interlinked with each other, form an endless transportation chain. In order to form a specially flexible and space-saving chain each ammunition holder 1 is joined via lashings 54 to the next following ammunition holder 1 at both end faces 43, 44 (FIG. 2) via the support pins 53 of the end walls 45, 46 (FIG. 2). The housing shape 34 (FIG. 3) of the ammunition holder 1 is configured in the region 6 (FIG. 2) for the cartridge bottom in such a way, that with a horizontally moving and guided band magazine 35 driven in a known manner the holding clamps 9, 10 are always arranged on the outside, either on the upper or lower side of the band magazine 35 at the ammunition holder 1, whereby the horizontally mounted and thin-walled cartridged ammunition 3 is expelled at the rear non-illustrated turning point of the band magazine 35 when the holding clamps 9, 10 are opened to be obliquely received from above and at the forward turning point 36, also with opened holding clamps 9, 10, are adapted to be expelled obliquely downwardly into a loading tray 55.

Although only a single embodiment of the invention has been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

We claim:

1. An ammunition holding mechanism for an automatic loading arrangement for gun barrel weapons, which holding mechanism when arranged in a juxtaposed plural arrangement forms a link of an interlinked endless ammunition magazine, comprising in combination, (a) said holding mechanism including an arcuately shaped tray for receiving the cartridged ammunition having a projectile head and a casing with a casing bottom, which tray has a semi-circular shape and at least two support regions, the inner diameter ($d_1$) of the first support region for supporting the forward region of the projectile of the cartridged ammunition is smaller than the inner diameter ($d_2$) of the second support region for supporting the rear region of the casing;

(b) pivotally mounted holding means for partially encompassingly holding the cartridged ammunition in each support region, each of said holding means being mounted on the same longitudinal side of the tray;

(c) each of said holding means including a pair of arcuately shaped clamp members pivotally connected to each other, an opening and closing mechanism operatively connected to said pair of clamp members for independently operating each holding means with respect to the other holding means, and prestressing means operatively connected to each holding means for independently biasing each holding means into a closed position in which it holds radially playfree the cartridged ammunition in the two support regions.

2. The ammunition holding mechanism for an automatic holding mechanism for an automatic loading arrangement, as set forth in claim 1, wherein each opening and closing mechanism includes a stroke-lever one end of which is pivotally connected to one of the clamp members of each pair of clamp members at a point spaced from the mutual pivotal connection of the pair of clamp members, and the other end of which has a bore into which a pin matingly projects, said pin being integral with and eccentric with respect to drive shaft means rotatably mounted on said tray and forming part of said opening and closing mechanism.

3. The ammunition holding mechanism for an automatic loading arrangement as set forth in claim 2, wherein said pin, drive shaft means and bore in said stroke-lever are adapted to assume a safety position in which said pair of clamp members are in the closed position which position they are biased to by said prestressing means.

4. The ammunition holding mechanism for an automatic loading arrangement as set forth in claim 3, wherein (a) said drive shaft means include a pair of misaligned drive shafts which are operatively coupled to each other by formlocking means;

(b) said formlocking means is mounted on a first shaft of said pair of shafts includes an automatically driven opening lever and said formlocking means mounted on a second shaft includes an entraining member, whereby said opening lever and entraining member are mutually arranged in such a way that only during the opening of the pair of clamp members the entraining member is coupled to the opening lever.

5. The ammunition holding mechanism for an automatic loading arrangement as set forth in claim 4, wherein for the basic adjustment of the opening lever and the entraining member the stroke-lever is coupled to the clamp members via a fine adjustment mechanism.

6. The ammunition holding mechanism for an automatic loading arrangement as set forth in claim 5, wherein said fine adjustment mechanism includes a bolt rotatably mounted in each clamp member, a pin eccentrically extending from the bolt and coacting with the stroke-lever.

7. The ammunition holding mechanism for an automatic loading arrangement as set forth in claim 6, wherein expelling means are mounted on said first and second drive shafts in the region where said clamp members are mounted thereon, said expelling means including a lever which uniformly expels the cartridged ammunition during opening of the clamp members from the ammunition holding mechanism.

8. The ammunition holding mechanism for an automatic loading arrangement as set forth in claim 7, wherein the shape of the outer periphery of the holding mechanism in the region where the cartridge casing bottom is supported is shaped in such a way that the horizontally moving endless ammunition magazine formed by the plural juxtaposed arrangement of interlinked holding mechanisms is such that the clamp members of each holding mechanism are always mounted on the exterior periphery of the endless ammunition magazine so that horizontally supported cartridged ammunition is being transported by said endless magazine it can be removed when the clamp members are open obliquely upwardly at the rear turning point of the endless magazine and it can be expelled obliquely downwardly at the forward turning point of the endless magazine.

9. The ammunition holding mechanism for an automatic loading arrangement as set forth in claim 8, wherein (a) the clamp members are biased into a clamping position by means of mechanical prestress means;

(b) said mechanical prestress means comprise coil springs mounted on said first and second shafts, one end of each coil spring being fixed to the respective shaft and the other end being fixed to the holding mechanism.

* * * * *